United States Patent [19]

Wendel

[11] 4,063,735

[45] Dec. 20, 1977

[54] CB RADIO HIGHWAY BOARD GAME APPARATUS

[76] Inventor: Dan P. Wendel, 202 Crossroad Court, Hendersonville, Tenn. 37075

[21] Appl. No.: 666,661

[22] Filed: Mar. 15, 1976

[51] Int. Cl.[2] ..... A63F 3/00

[52] U.S. Cl. ..... 273/134 AC; 273/134 B; 273/134 C; 273/134 D; 273/134 E

[58] Field of Search ..... 273/134

[56] References Cited

U.S. PATENT DOCUMENTS 952,997 3/1910 Sanderson ..... 273/134 AC 1,652,851 12/1927 Bendtin ..... 273/134 AC

FOREIGN PATENT DOCUMENTS 525,521 8/1940 United Kingdom ..... 273/134 AC

*Primary Examiner*—Delbert B. Lowe

*Attorney, Agent, or Firm*—Abe Hatcher

[57] ABSTRACT

A competitive citizen's band (CB) radio game employing at least one toy radio with play or game pieces representing vehicles which move along major routes and past various hazards or obstacles according to chance selection until a winner reaches a set destination first.

7 Claims, 6 Drawing Figures

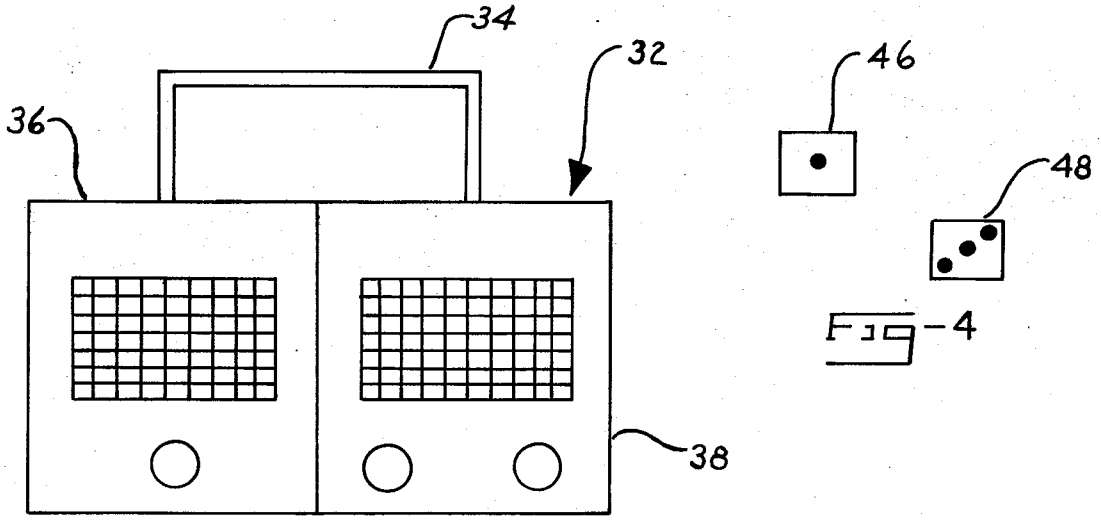
Fig-2
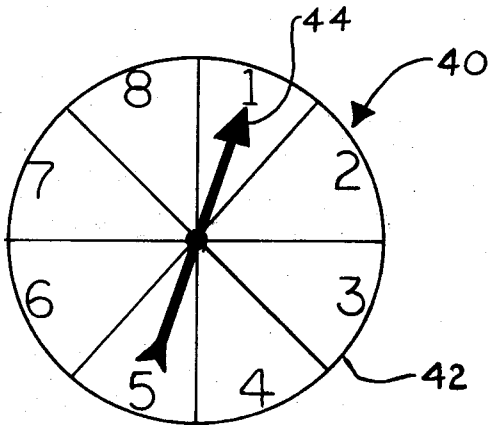
Fig-3
Fig-4
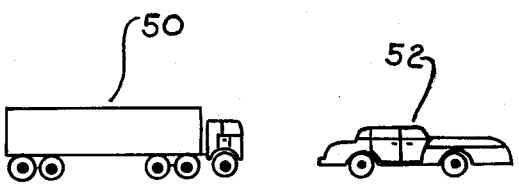
Fig-5
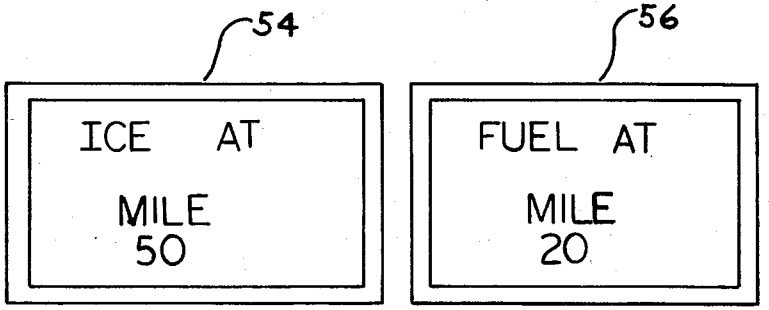
Fig-6

CB RADIO HIGHWAY BOARD GAME APPARATUS

BACKGROUND OF THE INVENTION

1. Field of the Invention

This invention relates to games. More particularly, it relates to a playboard-type game in which the players use a spinner, dice or the like to determine how far their game pieces move over certain highway courses past hazards and toward pre-determined destinations.

2. Description of the Prior Art

People travel today more than they ever have before, yet there is no game available which enables youngsters to simulate the many thrills as well as setbacks which occur in the course of travel over modern highways and throughways, for example, those of the great United States interstate system. After extended investigation, I have devised a game which does just this, while at the same time permitting participants to remain at home and still enjoy these thrills and setbacks without having to actually experience any of the bad features of highway travel, such as risking bad weather and chancing accident and possible arrest when exceeding a particular speed limit.

SUMMARY OF THE INVENTION

In its broader aspects, my invention involves moving play pieces such as toy vehicles or checker-like squares or circular objects by chance selection along various routes depicted on a playboard as in a map. If a player reaches the objective or terminus decided upon for him with his vehicle or convoy before another player reaches his agreed destination, he wins the game. The number of miles or spaces a player moves along his particular highway is preferably determined by use of a spinner, although dice may be employed, if desired, or any other conventional chance number selection system. Each player takes his turn in moving. A spinner may be used to decide who goes first, for example, with the person spinning the highest number starting, the person spinning the next highest number going second, and so on. Certain spaces on each route, highway or interstate may be designated as communication spaces. If a player lands on one of these, he is entitled to communicate with an oncoming player, that is, a player moving in the opposite direction along the same route toward the other player's point of departure, for example, by using a toy CB radio, which may be only a symbolic playpiece rather than a working model, to see what hazards and/or obstacles he may be up against along the remainder of his course. Alternatively, every space may be designated as a communication point which enables a player when his turn comes to either use the spinner or give up his usual move by communicating with an oncoming player. The oncoming player may either use cards with standard answers marked thereon for use in replying, or he may prefer to make up an answer and announce it to his requesting opponent. Each player may have several vehicles, representing a convoy, and either move all the number of miles or spaces indicated by the result of his use of the spinner or dice for a single vehicle, or spin or roll dice separately for each of his convoy vehicles. He may either spin for each vehicle during his turn or for just one and then spin for another at his next turn. If a convoy is used, the first player to get all his vehicles to his destination wins the game.

The obstacle cards or messages used by an oncoming player in answer to a moving player's request by toy CB radio or otherwise may state that there is a stalled vehicle at "Mile 9", "Space 9", or "Marker 9", for example. This could mean, if desired, that on his next move the player could not move beyond that point even if his spun number otherwise happened to entitle him to proceed farther, or it could require the player meeting the obstacle to move backward a few spaces or to detour via a national or state highway, for example, if he is at the time moving along an interstate highway.

A typical obstacle card or answer might be, for example, "Smokey at Mile Marker 50". Detour routes may be used where obstacle cards or answers given by an oncoming player so require. Terms used herein and in the game are those familiar to CB radio operators, but a single code list or one for each player could be provided, if desired.

Following, in outline form, are representative general instructions, directions, objects, rules of the game, and the like.

OBJECT

To move toy vehicles from one location to another on a game board along marked highways. There are preferably two to four players.

OBSTACLES

A player moving in opposite direction to that of another may hold certain cards which may impede the movement of his opponent.

MOVEMENT

Players move their vehicles according to indications selected by chance by spinning the dial on a spinner, throwing dice or using a like chance indicator.

OBSTACLE CARD

Markings on the spinner, designations on the game board, or agreements between players allow a player to draw a card or give a CB radio answer which may be used against his opponent when his opponent desires to call for an answer when his turn comes instead of using the spinner, dice or like chance selector.

USE OF CB RADIO

A choice may be given to each player on each turn to either spin and move, or to "Break 19" and talk on a CB radio to get a road report from an oncoming player. The oncoming player must answer by revealing an obstacle. He may be required to use the top or bottom card from a deck or select one by chance, if desired.

OPTIONS

A simulated CB radio or other-type 2-way radio for each player, or a workable model, with a speaker and microphone, capable of reproducing ungarbled messages.

GAME COMPONENTS

1. A road map or other route layout, for example, on a playing or game board.
2. A spinner or other chance means such as dice for determining movement of each player's vehicle.
3. Speakers and microphones to be used as CB radios (optional).
4. Cards which give road conditions for oncoming players (optional).

5. Simulated vehicles such as checkers, blocks or toy trucks for the players to move along map routes or highways.

ILLUSTRATIVE RULES

1. Each player spins, and the highest number or spinner goes first.

2. Each player has four vehicles, for example two 18-wheelers, one 6-wheeler and one 4-wheeler. Each vehicle may be a different color to match a color on the spinner. Each vehicle may have a corresponding-color starting point and ending point.

3. A player spins and moves his vehicle the number of miles or spaces shown on a spinner or cast by a pair of dice. A vehicle moves along mile markers on the game board. If the dial or arrow of the spinner falls on a line, a player spins again and if the spinner falls on a portion marked "Take a Card", the player takes an obstacle or hazard card to be used against his opponent.

4. When his turn comes, a player may either spin or "Break 19", that is, call on his radio or ask an oncoming player directly to give him a road report, which his opponent may either think up or select from marked cards.

5. If a player calls "Break 19" on the simulated CB he is not permitted to move on that turn. The oncoming player must give him an obstacle report. If he uses a card to report, he must return the card used to the bottom of a pile.

6. If a player receives a road report, he may relay information back to his own convoy. Preferably, once a player relays a message, none of his vehicles may incur a penalty for the mile marker for which the report was given.

7. If a player does not break 19 or call for an obstacle report and lands on a mile marker that the oncoming player holds a card for or designates, he must follow the penalty printed on that card, or one required by his opponent.

8. The first player to get all of his vehicles to his destination wins. At any time a player may break in and talk to his own convoy without penalty. However, this should be done before spinning or rolling the dice. A player should talk to only one vehicle in his convoy at a time.

Representative cards which may be employed for oncoming players to use in response to a CB radio request or the like may be marked as follows:

Smokey at Mile 5, D.O.T. at Mile 12, Rest Area at Mile 10, Chicken Coop at Mile 10, Fuel at Mile 20, Motel at Mile 18, Accident at Mile 10, Repair at Mile 16, Lunch at Mile 10, Ice at Mile 50, CB Out of Order, Coffee at Mile 42.

DESCRIPTION OF THE DRAWING

In the drawing,

FIG. 2 illustrates a toy radio having both sending and receiving means useful according to the invention.

FIG. 3 shows a spinner as representative chance selector means.

FIG. 4 depicts alternate chance selector means, specifically, dice.

FIG. 5 illustrates truck and automobile playpieces useful according to the invention on a map or playboard such as that shown in FIG. 1.

FIG. 6 shows cards representative of those useful in the game of the invention.

Figure 1:
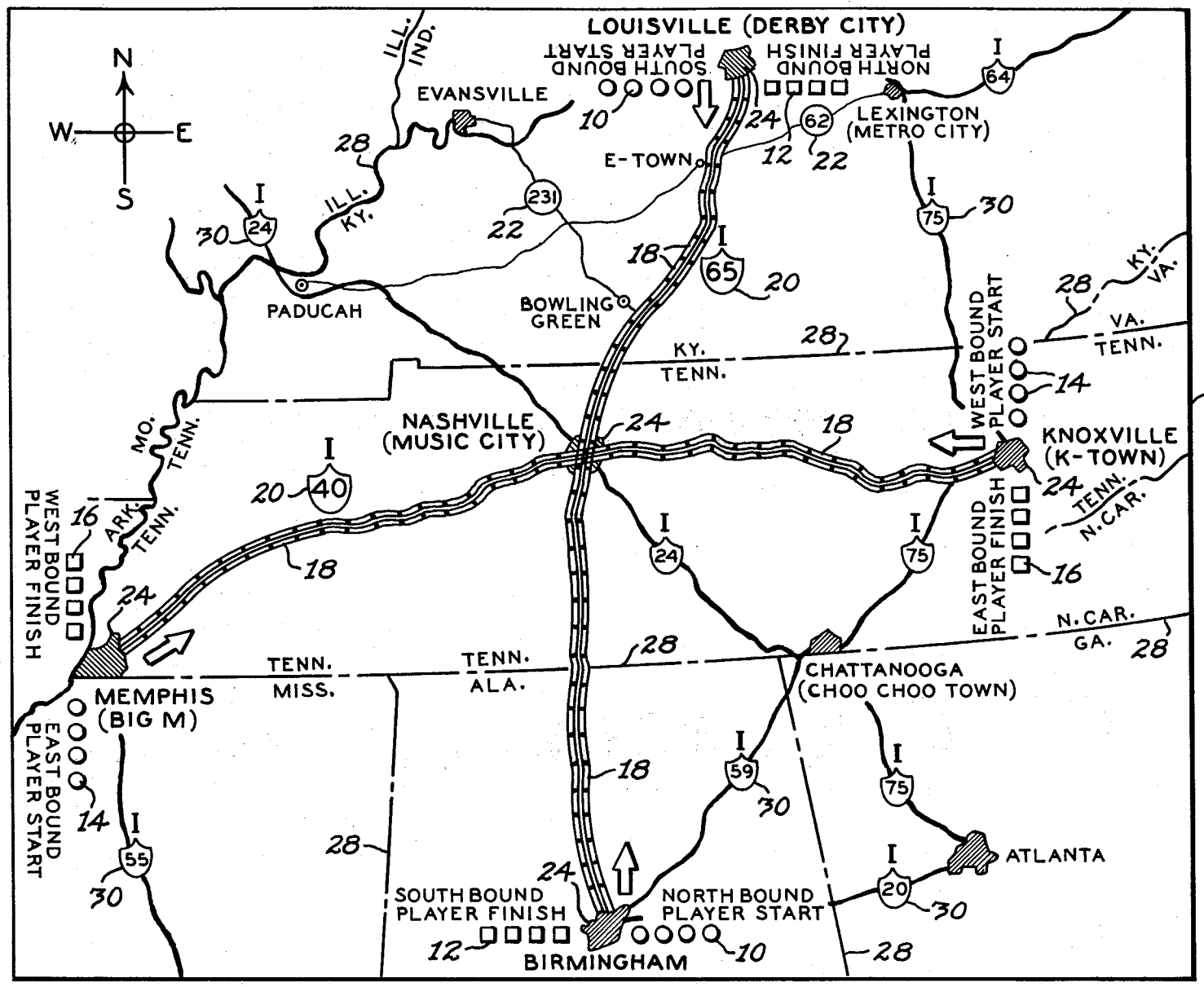
FIG. 1 is a schematic illustration of a map such as may be used as a gameboard in playing the game of the invention.

For a better understanding of my invention, reference will now be made to the drawing which forms a part thereof.

In FIG. 1 is shown a representative game or playboard containing a map or other route layout which may be used according to the invention. While Interstate Routes I65 and I40 are shown on the map of the drawing or playing board as the two major highways to be used in the game, other routes representing other sections of the United States or other countries of the world may also be used according to the invention. A northbound player, using representative vehicles such as the four designated 10, starts at Birmingham, which is the destination for the vehicles 12 of an oncoming southbound player who starts at Louisville. Likewise, a westbound player starts at Knoxville with vehicles 14 and proceeds to Memphis, from which his opponent leaves with vehicles 16, moving toward Knoxville. Interstate Highways 65 and 40 include mile markers or spaces 18 for players' vehicles to land on and move or depart from. These markers or spaces may have additional designations such as mile numbers, hazards, etc., if desired. Major interstate highways employed in the game for the moving of simulated vehicles thereon such as 40 and 65 are designated at 20. U.S. highways appear at 22 and major cities such as Louisville, Birmingham, Memphis, Nashville and Knoxville at 24. The map itself, or its boundaries, are indicated by 26, and state boundaries by 28. Other interstate highways, such as 20, 24, 55 and 75, are shown at 30.

FIG. 2 radio 32 includes a handle 34 and separate operative transmitting 36 and receiving 38 secions.

The spinner 40 of FIG. 3 is made up of pie-slice shaped numbered sections 42 and a spinning arrow 44.

Playing dice 46 and 48 are shown in FIG. 4.

FIG. 5 depicts a truck 50 and automobile 52.

In FIG. 6 one sees representative cards 54 and 56 for use by players in response to CB radio requests as explained hereinabove.

While the invention has been described in terms of preferred embodiments, the claims appended hereto are intended to encompass all embodiments which fall within the spirit of the invention.

Having thus described my invention and certain preferred embodiments thereof, I claim:

1. A highway game comprising, as components for use in playing same, a map, play pieces representing vehicles adapted to be moved along highways on said map, at least one toy radio, and a chance selector for determining the number of spaces to be moved upon a player's turn.

2. The game of claim 1 wherein the map comprises a game board having various routes with spaces to move to depicted thereon.

3. The game of claim 1 wherein the toy radio is capable of both sending and receiving messages.

4. The game of claim 1 wherein the chance selector comprises one or more dice.

5. The game of claim 1 having as an additional component thereof at least one set of cards with obstacles marked thereon.

6. The game of claim 1 wherein the at least one toy radio comprises a microphone and a speaker.

7. The game of claim 1 having as additional components thereof a set of obstacle cards and a toy capable of receiving messages.

* * * * *